US005217035A

United States Patent [19]

Van Marcke

[11] Patent Number: 5,217,035

[45] Date of Patent: Jun. 8, 1993

[54] SYSTEM FOR AUTOMATIC CONTROL OF PUBLIC WASHROOM FIXTURES

[75] Inventor: Karel C. Van Marcke, Kruishoutem, Belgium

[73] Assignee: International Sanitary Ware Mfg. CY, S.A., Kruishoutem, Belgium

[21] Appl. No.: 895,911

[22] Filed: Jun. 9, 1992

[51] Int. Cl.[5] ..... E03C 1/05

[52] U.S. Cl. ..... 137/1; 137/624.11; 251/129.04; 4/623

[58] Field of Search ..... 137/624.11, 624.13, 137/624.15, 624.18, 624.2, 1; 251/129.04; 4/623

[56] References Cited

U.S. PATENT DOCUMENTS

| | | | |
|---|---|---|---|
| 3,151,340 | 10/1964 | Teshima | 251/129.04 |
| 4,788,998 | 12/1988 | Pepper | 251/129.04 X |
| 4,886,207 | 12/1989 | Lee | 251/129.04 X |
| 4,914,758 | 4/1990 | Shaw | 4/304 |
| 4,941,219 | 7/1990 | Van Marcke | 251/129.04 X |
| 5,031,258 | 7/1991 | Shaw | 4/623 |
| 5,060,323 | 10/1991 | Shaw | 4/623 |
| 5,063,622 | 11/1991 | Tsutsui | 251/129.04 X |
| 5,086,526 | 2/1992 | Van Marcke | 4/623 |
| 5,095,941 | 3/1992 | Betz | 251/129.04 X |

*Primary Examiner*—Alan Cohan

*Attorney, Agent, or Firm*—Cahill, Sutton & Thomas

[57] ABSTRACT

A washroom control system automatically controls water valves and soap valves by infrared sensing of a user's hands, testing a battery to determine whether enough energy is stored to reliably close a valve, and generating an alarm if the battery needs replacing. Initial sensing of a user's hands requires rapid nearby hand motion to avoid spurious detection, while continued user presence requires lower infrared sensor output signals. The system includes DIP switches set to control various delay times, whether valve open cycles are fixed or variable in accordance with continued user presence, whether a water valve is controlled in response to one or several infrared sensors, whether water valve operation is independent of or responsive to prior soap valve operation, and whether the water valves are for wash fountains or urinals. If a single water valve controls flow through plural wash fountain nozzles, a fixed length water flow cycle is retriggerable in response to any of a plurality of infrared sensors associated with the various nozzles or associated soap dispensers. If water valves are for urinals, valve opening is delayed by a preselected time after a user's presence is detected.

17 Claims, 5 Drawing Sheets

SYSTEM FOR AUTOMATIC CONTROL OF PUBLIC WASHROOM FIXTURES

BACKGROUND OF THE INVENTION

The invention relates to automatic control systems for public washroom fixtures such as faucet valves, soap dispensers, electric dryer switches, and the like.

There is a recognized need for sanitary public washroom controls that avoid the need for members of the public to physically touch lavatory faucet valve handles, paper towel dispensers, electric hand dryers, soap dispensers, urinal flush valve handles, and the like. There is also a recognized need to maximize conservation of water in public washrooms by preventing faucets from being left open. Various sensors are known which sense the presence of a person's hand beneath a lavatory faucet to automatically turn on the water for a set interval without the need for the person to physically touch a control handle. Generally, each such sensor is directly linked to a water valve, soap valve, or the like. Patents 4,914,758 and 5,031,258, assigned to Bauer Industries, Inc., are believed to be representative of the state-of-the-art. Actuation of a large number of solenoid valves in some instances consumes more power than is desirable. Use of multiple solenoid valves in some cases is costly enough that it would be desirable to reduce the number of solenoid valves.

Accordingly, there is a unmet need for a relatively inexpensive, easily installed control system which automatically senses the presence of a person at a wash basin or urinal and automatically opens faucet valves, soap dispenser valves, turn on hand dryers, etc., and which minimizes power consumption in battery-powered systems, prevents water valves from remaining open due to battery failure, and produces an alarm indicating a low charge battery condition.

SUMMARY OF THE INVENTION

Accordingly, it is an object of the invention to provide an automatic system for control of multiple lavatory faucets, soap dispensers, hand dryers, urinals, and the like for a public washroom so as to avoid the need for a person to physically touch any of the washroom fixtures.

It is another object of the invention to provide an automatic system of the type described that minimizes use of water.

It is another object of the invention to provide an automatic system of the type described that minimizes the number of solenoid valves required for automatic operation of multiple lavatory faucets, soap dispensers, urinals, and the like, especially in battery-powered systems.

It is another object of the invention to provide an automatic system of the type described that reduces the likelihood of solenoid valves being left open as a result of battery failure.

It is another object of the invention to provide a control system of the type described which can be easily installed without connection to AC line voltage.

Briefly described, and in accordance with one embodiment thereof, the invention provides a control system to automatically control the water valves and soap valves by operating a first infrared sensor to sense the presence of a user close enough to a first water valve to indicate the user's intention to use the first water valve. An output signal of the first infrared sensor is compared to a first threshold to indicate user presence if the magnitude of the output signal exceeds the first threshold. A battery that supplies power to the first water valve is tested to determine if the battery contains enough energy to close the first water valve, and, if not, the first alarm indication is produced and further opening of the first water valve is prevented. A first configuration switch is tested to determine if a first soap valve and the first water valve are to be independently controlled, and if so, opening the first water valve, and waiting until the first soap valve is closed. The first water valve is opened without delay if the first soap valve and the first water valve are not to be independently controlled. If the first water valve is for a wash fountain, a water valve timer is reset and operated to measure the duration of water flow through the first water valve, and after a first delay, a hand dryer device control signal is generated. A second configuration switch is tested to determine if the duration of water flow through the first water valve is to be variable, and if so, the first infrared sensor is operated to sense continued presence of the user near the first water valve by comparing the output signal of the first infrared sensor to a second threshold that is lower in magnitude than the first threshold. The first water valve is closed if the output signal of the first infrared sensor is less than the second threshold or if the water valve timer has exceeded a maximum setting. If the duration is not to be variable, the first water valve is closed if the water valve timer has exceeded the maximum setting. In the described embodiment, the battery is tested to determine if it needs replacing in the near future and, if so, a second alarm indication is produced. A third configuration switch is tested to determine if the first water valve is for a wash fountain or a urinal. If it is for a wash fountain, the first water valve is opened immediately after testing of the third configuration switch. If the first water valve is for a urinal, the first water valve is closed after the third delay. A second infrared sensor is operated to sense the presence of a user close enough to the first soap valve to indicate the user's intention to use the first soap valve. An output signal of the second infrared sensor is compared to a third threshold to indicate user presence if the magnitude of the output signal exceeds the third threshold. A battery that supplies power to the first soap valve is tested to determine if the battery contains enough energy to close the first soap valve, and, if not, the first alarm indication is produced and further opening of the first soap valve is prevented. The first soap valve is opened for a first duration and then closed. In the described embodiment, the control system may include a second infrared sensor. A fourth configuration switch is tested to determine if the first water valve controls water through a plurality of nozzles, in which case the second infrared sensor is operated in the same manner as the first, the first water valve is opened in response to either the output signal of the first infrared sensor or an output signal of the second infrared sensor. In the described embodiment, a configuration switch can be set to determine that operation of the first water valve is dependent upon prior operation of the first soap valve. In this case, an additional delay is provided after the soap valve has been actuated in response to an associated infrared sensor, and then operation of an associated water valve is initiated opening the first water valve as previously described, generating a hand dryer device control signal, and maintaining the first water valve opened for a preselected fixed time which is retriggerable in response to any infrared sensor associated with any soap dispenser.

DETAILED DESCRIPTION OF THE PREFERRED EMBODIMENTS

Figure 1:
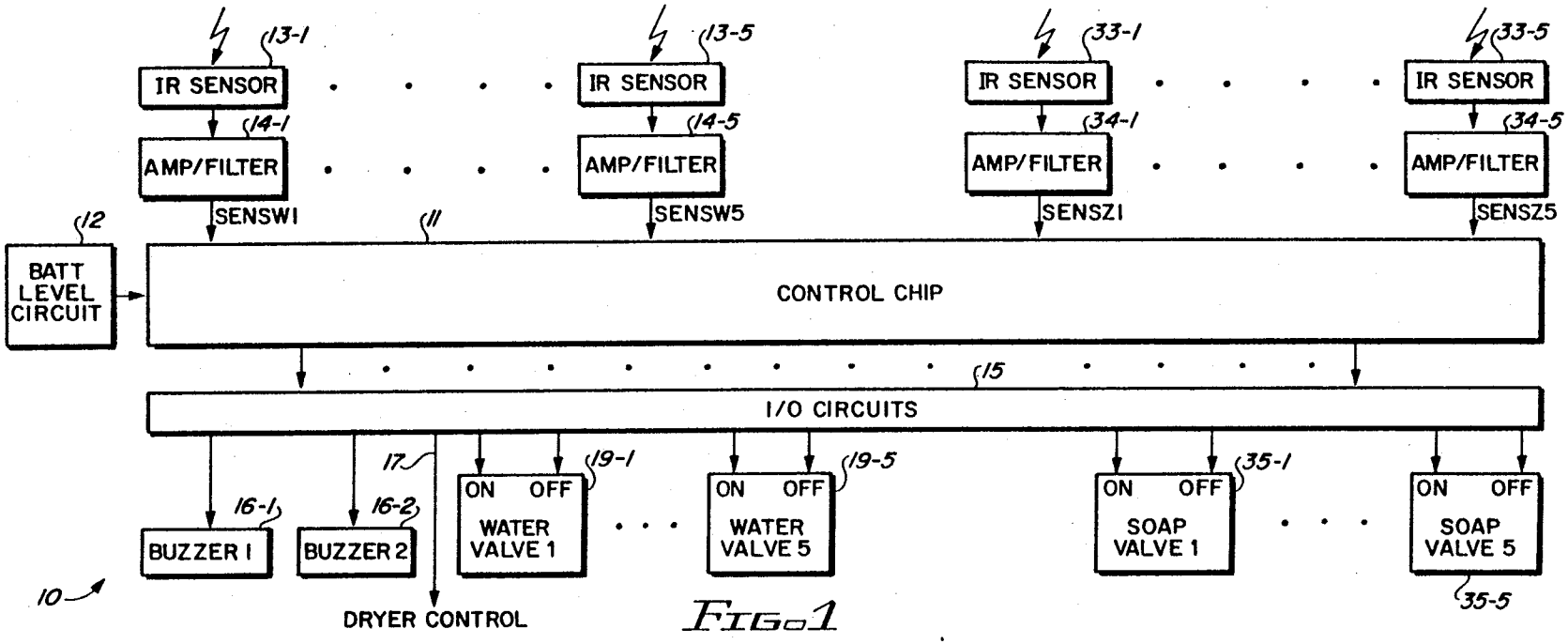
FIG. 1 is a block diagram illustrating the control system of the present invention.
Figure 2C:
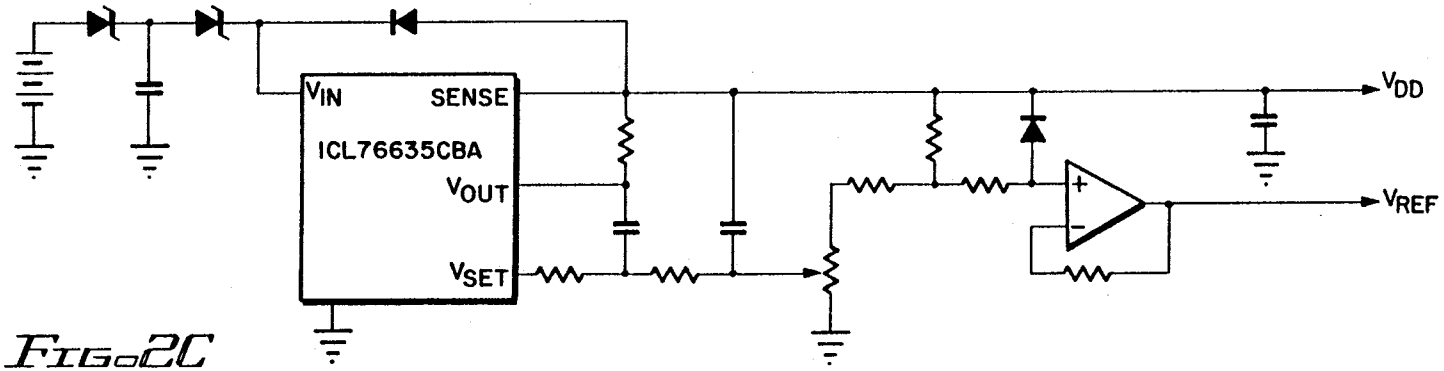
FIG. 2C is a circuit diagram of a reference voltage generating circuit used in the system of FIGS. 2A and 2B.
Figure 2B:
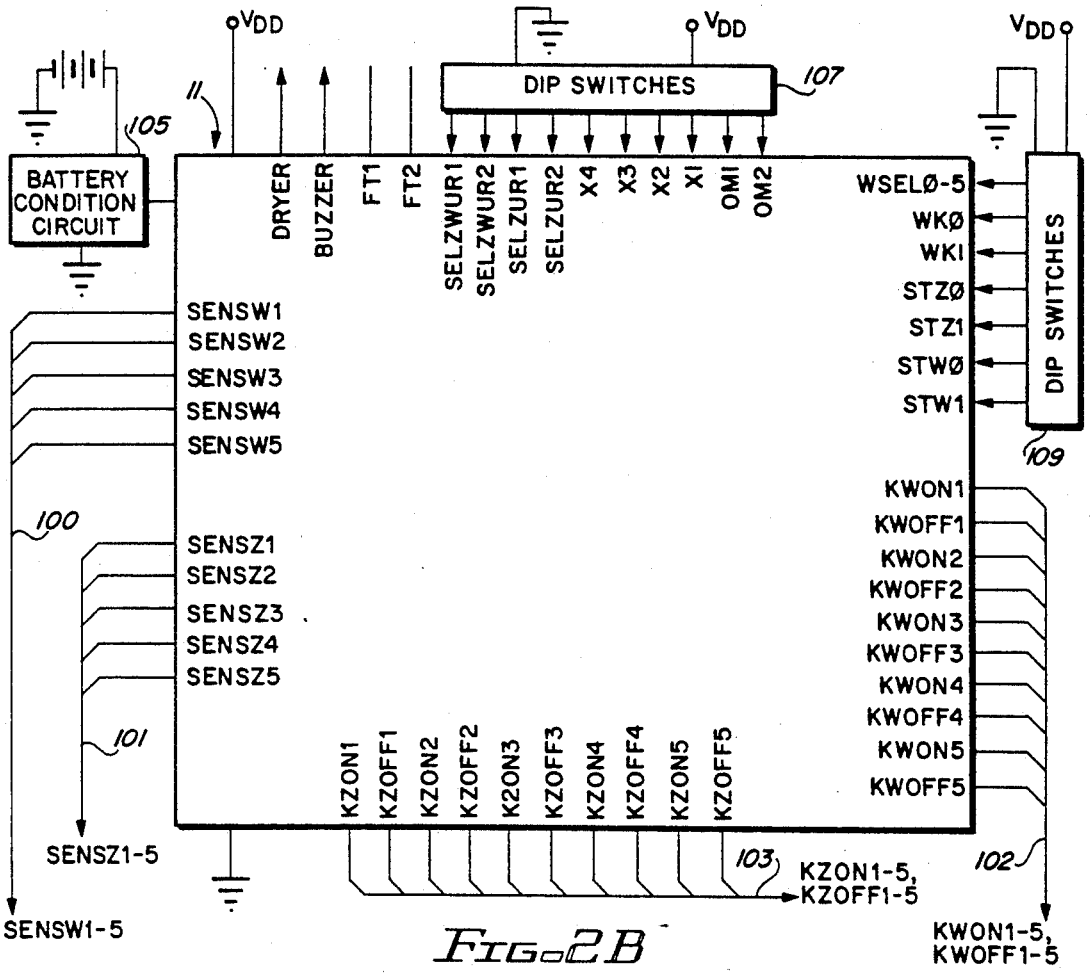
FIG. 2B is a block diagram illustrating connections of DIP switches to a control chip used in the system of the present invention and also indicating the input signals and output signals of the control chips.

Referring to FIGS. 1 and 2B, washroom fixture control system includes an integrated circuit control chip 11 that includes a state machine, the states of which are set forth according to Table 1. The state machine and associated logic circuitry, which can be effectively implemented in conventional CMOS logic circuitry in control chip 11, performs the functions set forth in the flowcharts of FIGS. 3A and 3B.

Control chip 11 has inputs that receives five water valve output signals SENSW1 . . . SENSW5 which detect the presence of a user's hands adjacent to infrared sensors 13-1, 13-2 . . . 13-5, respectively, beneath corresponding water faucet or fountain nozzles. Control chip 11 also has inputs that receive the five soap valve output signals SENSZ1 . . . SENSZ5 produced in response to presence of a user's hands adjacent to infrared sensors located adjacent to corresponding soap dispenser valves. The signals SENSW1 . . . SENSW5 are produced by amplifier/filter circuits 14-1 . . . 14-5, respectively. The outputs of infrared sensors 13-1 . . . 13-5 are applied to inputs of amplifier/filter circuits 14-1 . . . 14-5, respectively. Similarly, the outputs of infrared sensors 33-1 . . . 33-5 are connected to inputs of amplifier/filter circuits 34-1 . . . 34-5, respectively, to produce the SENSZ1 . . . SENSZ5 signals.

Sensors 13-1 . . . 13-5 are positioned to control individual water valves of a wash basin, wash fountain, or the like in response to movement or presence of a person's hand close to water valves. Similarly, infrared sensors 33-1 . . . 33-5 are positioned to control individual soap valves of soap dispensers in response to movement or presence of a person's hand close to the soap valves.

Integrated circuit chip 11 has various outputs 102 and 103 (FIG. 2B) connected to power drivers in block 15 (FIG. 1). The outputs 102 include water valve open (i.e., on) signals KWON1, KWON2 . . . KWON5 and water valve closed (i.e., off) signals KWOFF1 . . . KWOFF5. The soap valve control outputs 103 include soap valve on (i.e., open) signals KZON1 . . . KZON5 and soap valve off (i.e., closed) signals KZOFF1 . . . KZOFF5. The power driver circuitry 15 drives a 4 kilohertz buzzer 16-1 and a 2 kilohertz buzzer 16-2. Power driver circuitry 15 also supplies signal 17 to control a hand dryer or towel dispenser 17, five water valve "on" and five water valve "off" signals to five water valves 19-1 . . . 19-5, and five soap valve "on" and five soap valve "off" signals to five soap valves 35-1 . . . 35-5. A battery pack (not shown) powers a circuit producing a power-reset signal and a $V_{DD}$ supply voltage to control chip 11. Control chip 11 and the various water solenoid valves and soap solenoid valves can be powered by a battery pack, for example, one containing 3D-type dry cells.

TABLE 1

```
/*state machine description for water block*/

water valve sequencer

signal /* Inputs */Definitions
  start
  bat_6.3v
  bat_6.8v
  stop_timer
  sel_0_5                  ┐
  sel1_4a                  │
  sel1_4b                  │
  sel2_8a                  │
  sel2_8b                  │   DIP SWITCH INPUTS
  x2                       │
  x3                       │
  x4                       │
  timer on max setting     ┘
```

```
  SENS signal for position i
  z_i_off

signal /* Outputs */Definitions
  alarm tone_2hz
  alarm tone_4hz
  w_on
  w_off
  start_timer
  delay_2sec
  delay_3sec
  delay_4sec
  delay_5sec
  delay_6sec
  delay_8sec
  delay_16sec
  delay_32sec
  delay_48sec
  delay_64sec
  reset_presence
  present timer value
  dryer pulse on

state
  start_ok
  bat_attention
  alarm_6.3v
  bat_ok
  alarm_6.8v
  wait_until_z_i_off
  select_wait_0_5
  timer_wait_5sec
  timer_2_wait_5sec
  timer_2_wait_2sec
  timer_2_wait_4sec
  timer_2_wait_6sec
  timer_2_wait_8sec
  timer_3_wait_2sec
  test_x3_1
  wait_16_32_48_64sec
  wait _2_4_6_8sec
  test_x2_1
  individual
  water_off
  timer_wait_16sec
  timer_wait_32sec
  timer_wait_48sec
  timer_wait_64sec
  Sens(W_i)


  constant ValSel = [sel1_4b,sel1_4a]
  constant Sel_0 = ValSel == 0
  constant Sel_1 = ValSel == 1
  constant Sel_2 = ValSel == 2
  constant Sel_3 = ValSel == 3
```

```
  constant ValSel2 = [sel2_8b,sel2_8a]
  constant Sel_2_0 = ValSel2 == 0
  constant Sel_2_1 = ValSel2 == 1
  constant Sel_2_2 = ValSel2 == 2
  constant Sel_2_3 = ValSel2 == 3

initialize start_ok

state start_ok
  if (start) goto bat_attention
  else goto start_ok

state bat_attention
  if (bat_6.3v) goto bat_ok
  else
    start_timer:=1
    goto alarm_6.3v with delay_6sec := 1

state alarm_6.3v
  delay_6sec := 1
  alarm tone_4hz := 1
  if (stop_timer) goto alarm_6.3v
  else goto start_ok with reset_presence :=1

state bat_ok
  if (bat_6.8v) goto test_x3_1
  else
    start_timer :=1
    goto alarm_6.8v with delay_3sec := 1

state alarm_6.8v
  delay_3sec := 1
  alarm tone_2hz := 1
  if (stop_timer) goto alarm_6.8v
  else goto test_x3_1

state test_x3_1
  if (x3)                              [ANTICIPATING SOAP CYCLE]
    if (x4) goto wait_16_32_48_64sec
    else goto wait_until_z_i_off
    else goto individual

state wait_16_32_48_64sec
  if (Sel_0) goto timer_wait_16sec with  delay_16sec := 1
  if (Sel_1) goto timer_wait_32sec with  delay_32sec := 1
  if (Sel_2) goto timer_wait_48sec with  delay_48sec := 1
  if (Sel_3) goto timer_wait_64sec with  delay_64sec := 1
  start_timer :=1

state timer_wait_16sec
  delay_16sec := 1
  if (stop_timer) goto timer_wait_16sec
  else goto individual

state timer_wait_32sec
  delay_32sec := 1
```

```
  if (stop_timer) goto timer_wait_32sec
  else goto individual

state timer_wait_48sec
  delay_48sec := 1
  if (stop_timer) goto timer_wait_48sec
  else goto individual

state timer_wait_64sec
  delay_64sec := 1
  if (stop_timer) goto timer_wait_64sec
  else goto individual

state wait_until_z_i_off
  if (!z_i_off) goto wait_until_z_i_off

  else goto individual
```

<u>state individual</u>

```
  w_on :=1
  present timer value :=1
  if (!x4)
    goto timer_wait_5sec with delay_5sec := 1
    start_timer : =1

  else goto wait_2_4_6_8sec


state wait_2_4_6_8sec
  if (Sel_2_0) goto timer_2_wait_2sec with  delay_2sec := 1
  if (Sel_2_1) goto timer_2_wait_4sec with  delay_4sec := 1
  if (Sel_2_2) goto timer_2_wait_6sec with  delay_6sec := 1
  if (Sel_2_3) goto timer_2_wait_8sec with  delay_8sec := 1
  start_timer :=1


state timer_2_wait_2sec
  delay_2sec := 1
  if (stop_timer) goto timer_2_wait_2sec
  else goto water_off

state timer_2_wait_4sec
  delay_4sec := 1
  if (stop_timer) goto timer_2_wait_4sec
  else goto water_off

state timer_2_wait_6sec
  delay_6sec := 1
  if (stop_timer) goto timer_2_wait_6sec
  else goto water_off


state timer_2_wait_8sec
  delay_8sec := 1
```

```
  if (stop_timer) goto timer_2_wait_8sec
  else goto water_off

state timer_wait_5sec
  delay_5sec := 1
  if (stop_timer) goto timer_wait_5sec
  else goto select_wait_0_5 with dryer pulse on:=1

state select_wait_0_5
  if (sel_0_5)
    goto timer_2_wait_5sec with delay_5sec := 1
    start_timer :=1

   else goto test_x2_1


state timer_2_wait_5sec
  delay_5sec := 1
  if (stop_timer) goto timer_2_wait_5sec
  else goto test_x2_1


state test_x2_1

  if (!x2) goto Sens(W_i)
  else
    if (timer on max setting) goto water_off
    else goto test_x2_1


state Sens(W_i)

  if (SENS signal for position i) goto water_off
  else
    if (timer on max setting) goto water_off
    else goto test_x2_1

state water_off
  w_off :=1
  if (!x4)
    goto timer_3_wait_2sec with delay_2sec := 1
    start_timer :=1

  else goto start_ok with reset_presence := 1


state timer_3_wait_2sec
  delay_2sec := 1
  if (stop_timer) goto timer_3_wait_2sec
  else goto start_ok with reset_presence := 1

/*state machine description for soap block*/


fsm soap valve sequence
```

```
signal /* Inputs */Definitions
  start          bat_6.3v   bat_6.8v   sel0_1sec
  stop_timer     sel1_4a  sel1_4b    turn_on  x3
   wait_stop     sel1_2sec

signal /* Outputs */Definitions
  z_on           z_off          start_timer    delay_1sec
  delay_2sec.    delay_3sec     delay_4sec    delay_6sec
  reset_presence

state
  start_ok
  bat_attention
  alarm_6.3v
  bat_ok
  alarm_6.8v
  select_wait_0_1
  wait_before_zon
  start_wait_1_4sec
  start_wait_1_2sec
  wait_turn_on
  timer_wait_1sec_beep
  timer_wait_2sec_beep
  timer_wait_1sec
  timer_wait_2sec
  timer_wait_2sec_end
  timer_wait_3sec
  timer_wait_4sec
  x3_ok
  start_wait_stop

  constant ValSel = [sel1_4b,sel1_4a]
  constant Sel_0 = ValSel == 0
  constant Sel_1 = ValSel == 1
  constant Sel_2 = ValSel == 2
  constant Sel_3 = ValSel == 3

initialize start_ok

state start_ok
  if (start) goto bat_attention
  else goto start_ok

state bat_attention
  if (bat_6.3v) goto bat_ok
  else
    start_timer:=1
    goto alarm_6.3v with delay_6sec := 1

state alarm_6.3v
  delay_6sec := 1
  if (stop_timer) goto alarm_6.3v
  else goto start_ok with reset_presence :=1

state bat_ok
  if (bat_6.8v) goto select_wait_0_1
```

```
  else
    start_timer :=1
    goto alarm_6.8v with delay_3sec := 1

state alarm_6.8v
  delay_3sec := 1
  if (stop_timer) goto alarm_6.8v
  else goto select_wait_0_1

state select_wait_0_1
  if (sel0_1sec) goto wait_before_zon with
    delay_1sec := 1
    start_timer := 1

  else goto wait_turn_on with z_on := 1

state wait_before_zon
  delay_1sec := 1
  if (stop_timer) goto wait_before_zon
  else
    goto wait_turn_on with z_on := 1

state wait_turn_on
  if (turn_on) goto start_wait_1_4sec
  else goto wait_turn_on

state start_wait_1_4sec

  if (Sel_0) goto timer_wait_1sec with  delay_1sec := 1

  if (Sel_1) goto timer_wait_2sec with  delay_2sec := 1

  if (Sel_2) goto timer_wait_3sec with  delay_3sec := 1

  if (Sel_3) goto timer_wait_4sec with  delay_4sec := 1

  start_timer :=1

state timer_wait_1sec
  delay_1sec := 1
  if (stop_timer) goto timer_wait_1sec
  else
    z_off := 1
    goto start_wait_1_2sec

state timer_wait_2sec
  delay_2sec := 1
  if (stop_timer) goto timer_wait_2sec
  else
    z_off := 1
    goto start_wait_1_2sec

state timer_wait_3sec
  delay_3sec := 1
  if (stop_timer) goto timer_wait_3sec
  else
```

```
    z_off := 1
    goto start_wait_1_2sec

state timer_wait_4sec
  delay_4sec := 1
  if (stop_timer) goto timer_wait_4sec
  else
    z_off := 1
    goto start_wait_1_2sec

state start_wait_1_2sec

  if (!sell_2sec)  goto timer_wait_1sec_beep with
    delay_1sec := 1

  else goto timer_wait_2sec_beep with
    delay_2sec := 1

  start_timer :=1

state timer_wait_1sec_beep
  delay_1sec := 1
  if (stop_timer) goto timer_wait_1sec_beep
  else
    goto x3_ok

state timer_wait_2sec_beep
  delay_2sec := 1
  if (stop_timer) goto timer_wait_2sec_beep
  else
    goto x3_ok

state x3_ok
  if (x3) goto start_wait_stop
  else goto start_ok with reset_presence :=1

state start_wait_stop
  if (wait_stop) goto start_wait_stop
  else
    goto timer_wait_2sec_end with  delay_2sec := 1
    start_timer :=1

state timer_wait_2sec_end
  if (stop_timer) goto timer_wait_2sec_end
  else
    goto start_ok with reset_presence :=1
```

Figure 3A:
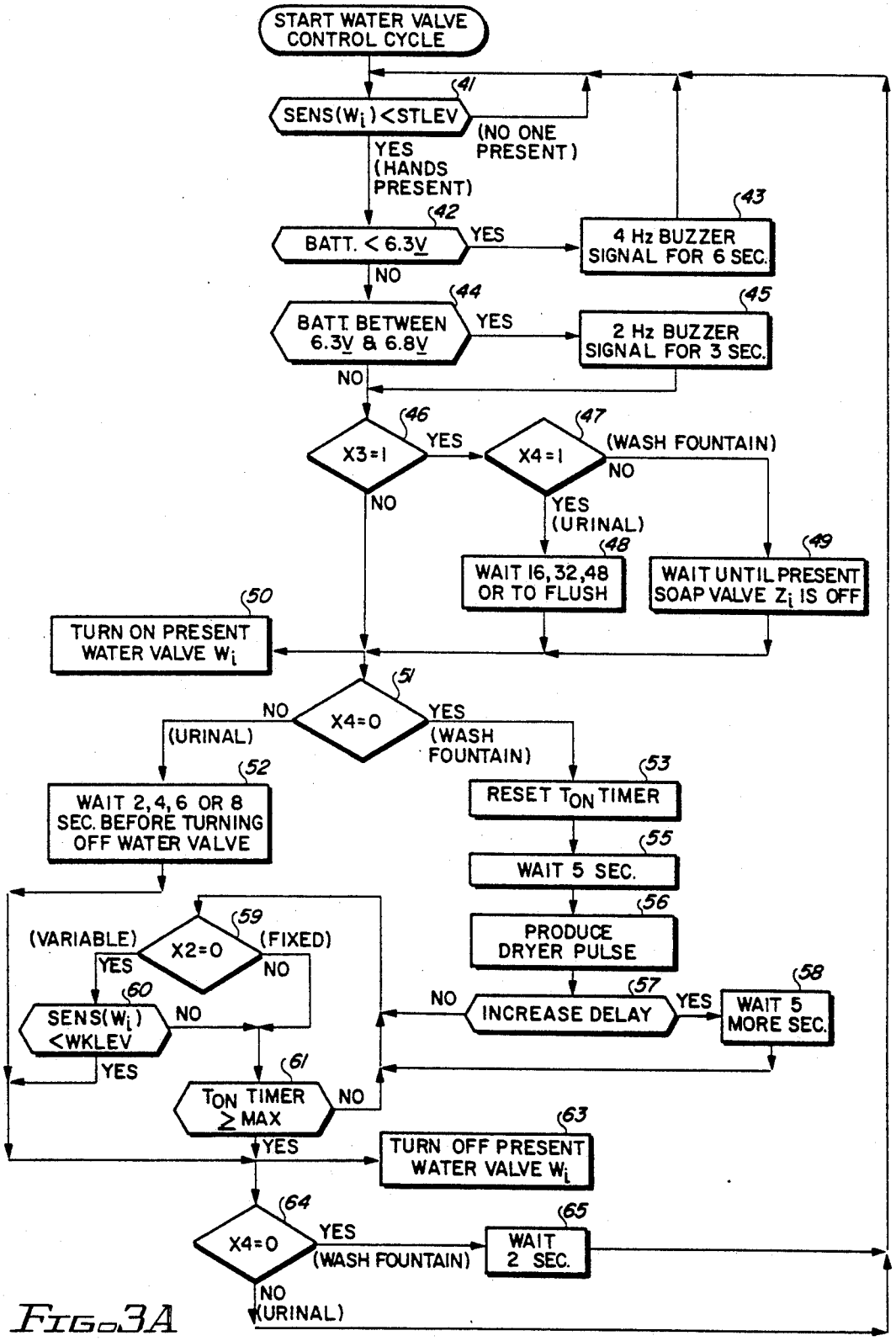
FIGS. 3A and 3B are flowcharts of functions performed by the control chip in FIG. 2B.
Figure 3B:
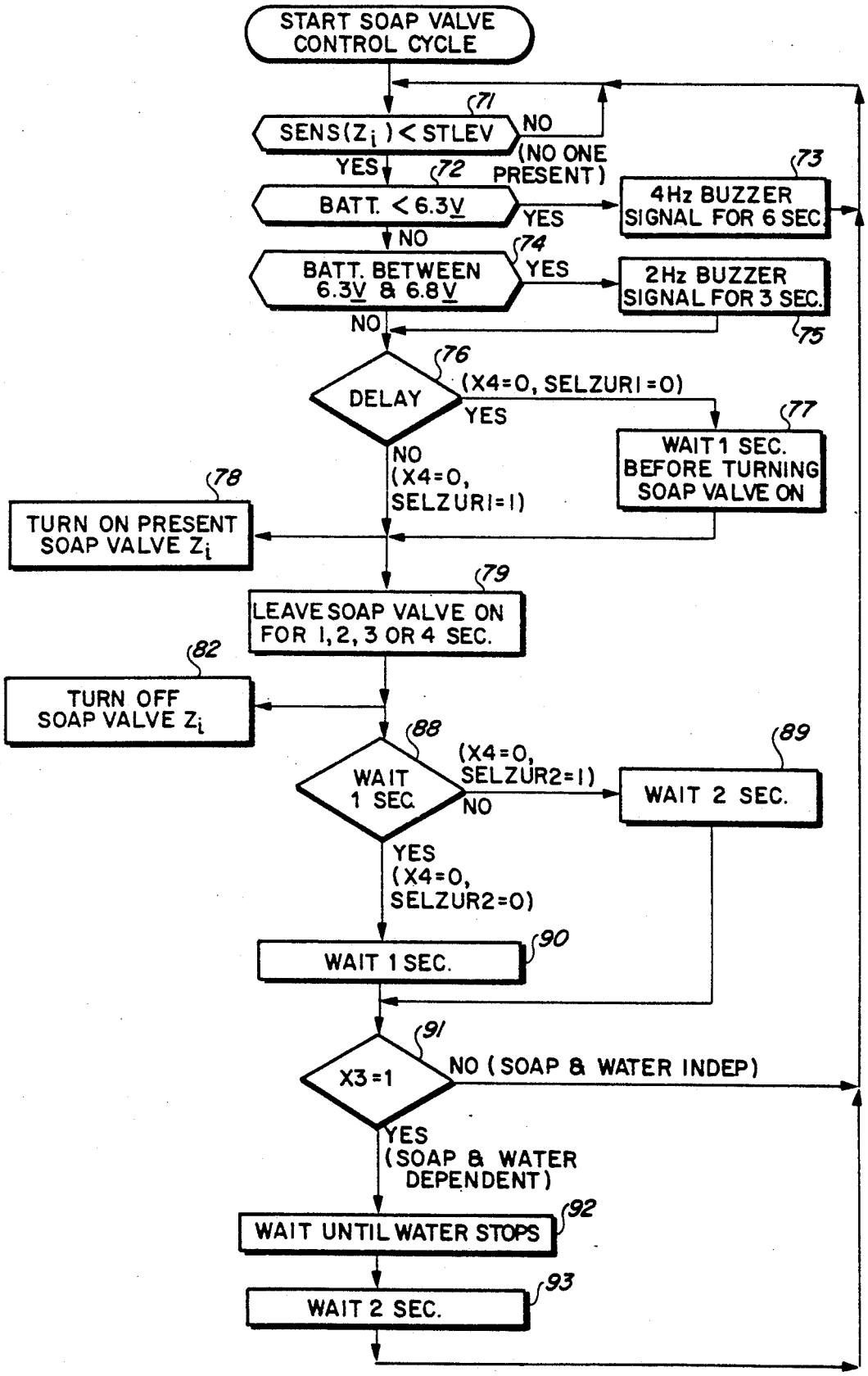

One skilled in the art can readily implement a logic circuit to perform the functions of the flowcharts of FIGS. 3A and 3B from the information contained therein and in Table 1.

Figure 2A:
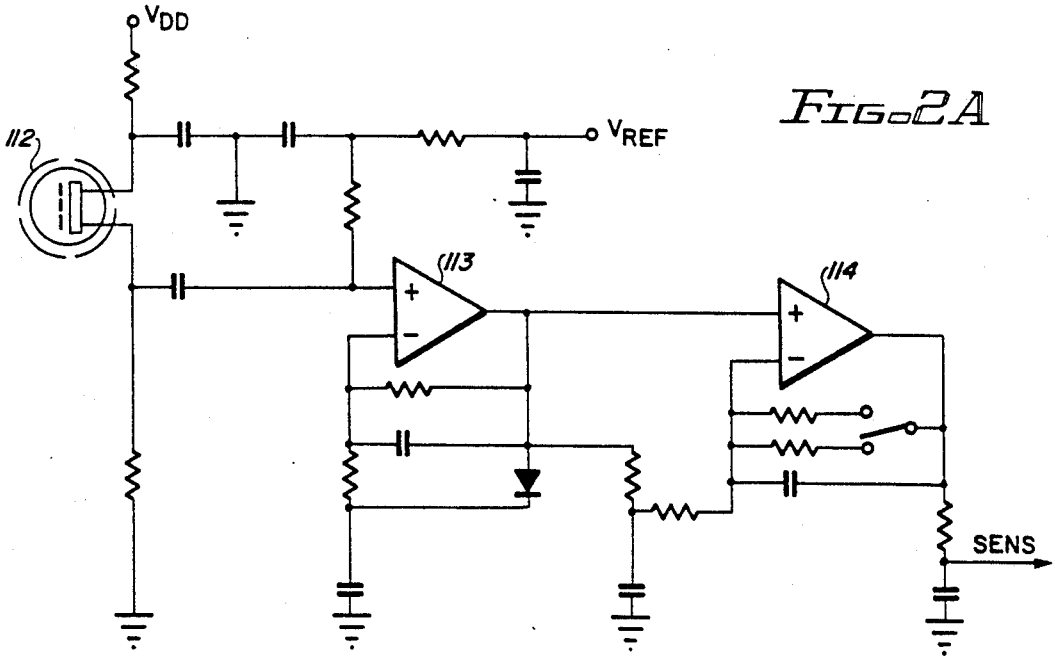
FIG. 2A is a circuit diagram of an analog amplifier circuit for receiving and amplifying a signal produced by an infrared motion sensor in response to nearby motion of a user's hands.

One aspect of the invention is that control chip 10, in conjunction with the various sensors connected to it, shown in detail in FIG. 2A, has a higher threshold value of STLEV, to initially detect suitable motion of a user's hands to start the fixture control process, than a lower threshold value of WKLEV to detect "continued presence" of the user's hands in order to continue control of the water and soap valves. The higher initial threshold prevents undesired opening of water valves or soap valves due to possible external influences, such as a gust of warm air.

Referring to FIG. 2A, an exemplary amplifier and bandpass circuit is shown for producing the signal SENS in response to the output of infrared sensor 112. The signal SENS is an AC signal, which varies between 0 and 4 volts. Infrared motion detector 112 can be an RPW100 dual element pyro-electric infrared sensor, available from Philips. Amplifiers 113 and 114 can be TLC27L2CD amplifiers, commercially available from Texas Instruments.

A 2 volt reference voltage $V_{REF}$ is generated by the circuit of FIG. 2C. The implementation of this circuit is conventional, and therefore is not described in detail, except to mention that the integrated circuit shown in FIG. 2C is an ICL76635CBA voltage regulator circuit.

The above-mentioned thresholds are converted by control chip 11 to analog signal levels which are compared by conventional comparators to the various SENS($W_i$) and SENS($Z_i$) signals produced by the various sensor amplifier circuits to detect amounts of user motion needed to initiate or maintain operation of the water valves and soap valves.

The presence of a user whose hands are moving into position to use a washroom fixture is definitely established by 32 readings of the AC signal SENS, including 16 readings below low STLEV (for example, 0.5 volts) and 16 readings above high STLEV (for example, 3.5 volts) these two upper and lower "start threshold levels" being centered about the two volt $V_{REF}$ line. A considerable amount of hand motion is required to establish the presence of a user. The corresponding "working threshold levels" against which SENS is compared are 16 readings below low WKLEV (for example, 1.0 volts) and 16 readings above high WKLEV (for example, 3.0 volts). Both the initial "start thresholds" and the "working thresholds" can be established by setting the STZ0 and STZ1 DIP switches (i.e., initialization switches), the STW0 and the STW1 DIP switches, and the WK0 and WK1 DIP switches in block 109 of FIG. 2B in accordance with Table 2.

TABLE 2

| START THRESHOLD LEVELS | | | |
|---|---|---|---|
| ST0 | ST1 | LOWER THRESHOLD | UPPER THRESHOLD |
| 0 | 0 | 0.5 | 3.5 |
| 1 | 0 | 0.75 | 3.25 |
| 0 | 1 | 1 v | 3 v |
| 1 | 1 | 1.25 | 2.75 |
| **WORKING THRESHOLD LEVELS** | | | |
| WKO | WK1 | LOWER THRESHOLD | UPPER THRESHOLD |
| 0 | 0 | 1 v | 3 v |
| 0 | 0 | 1.2 | 2.8 |
| 0 | 1 | 1.4 | 2.6 |
| 1 | 1 | 1.6 | 2.4 |

Thus, there are 32 tests per second of the SENS signal to determine if it exceeds the predetermined threshold excursions above and below the 2 volt $V_{REF}$ level. If the SENS signal does not exceed both upper and lower threshold levels 32 times, the presence of hands proximate to the sensor is not detected.

The OM1 and OM2 initialization switch inputs from block 107 of FIG. 2B allow the installer to set the desired delay to be 15, 20, 25, or 30 seconds for the maximum time for a water valve to be open in response to a particular sensor.

In the described embodiment of the invention, a "variable length" water flow cycle (which is established by the X2 DIP switch setting of "0") is initiated by detection of the suitable movement of a hand close to the appropriate infrared sensor. The length of such a water flow cycle, up to a maximum established by the OM1 and OM2 DIP switch settings, is determined by repeated sensing at the above-mentioned "working threshold" levels to detect continued presence (for example, even the slightest motion of the user's hands) near the appropriate infrared sensor.

A fixed, rather than variable, length water flow cycle established by the X2 DIP switch being set to a "1" opens a water valve for a certain number of seconds established by the DIP switches OM1 and OM2, regardless of the presence or absence of a user's hands in the proximity of the infrared motion sensor.

Depending on the settings of the X1, X2, X3, and X4 DIP switch settings in block 107 of FIG. 2A, control chip 11 effectuates different cycles of soap valve control and water valve control, depending upon whether (1) two infrared sensors are positioned at the faucet and the soap dispenser, respectively, (2) only one sensor is utilized and it is located at the faucet, (3) only one sensor is utilized and it is located at the soap dispenser, or (4) only one sensor is located between the water nozzle and the soap outlet when the water nozzle and soap outlet are located close together.

The washroom fixture control system described herein therefore is versatile, in that the same system can be installed to operate several different arrangements of water valves and/or soap valve or urinal valves, depending on how the X1, X2, X3, and X4 DIP switches are set and depending on the foregoing positions of the sensors. Table 3 lists the functions of the latter DIP switch settings.

The X1, X2, X3, and X4 initialization switches control which of the above control cycles are to be utilized for the particular installation desired, in accordance with the following.

TABLE 3

| SWITCH SETTING | FUNCTION |
|---|---|
| X1 = 0 | Each IR sensor controls one corresponding value |
| X1 = 1 | Multiple IR sensors control a single value |
| X2 = 0 | Variable length water cycles |
| X2 = 1 | Fixed length water cycle or re-triggerable fixed length water cycle |
| X3 = 0 | Soap valves and water valves independent |
| X3 = 1 | Soap valves and water valves dependent |
| X4 = 0 | Wash fountain control |
| X4 = 1 | Urinal control |

Referring next to FIG. 3A, the flowchart shows the sequence of operations and decisions performed by logic elements in control chip 11 to control the multiple (e.g., 5) water valves. In decision block 41 the value of the present water sensor signal level SENS(Wi) is tested 16 times to determine if its maximum value is above the presently selected upper value of STLEV, (present Start Level of threshold) which, for example, is +3.5 volts, and 16 times to determine if its minimum value is below the selected lower value of STLEV, which is 0.5 volts. A negative determination by decision block 41 means that there is insufficient hand motion near enough to the present water sensor to unambiguously establish the presence of a user that wants to turn on the water, so the testing of SENS(Wi) continues, 32 times per second.

An affirmative decision of block 41 leads to decision block 42, in which the battery voltage is tested to determine if it is less than 6.3 volts, the level at which insufficient energy remains in the battery to reliably turn the present water valve Wi off. If this is the case, buzzer 16-1 of FIG. 1 is activated to produce a 4 hertz sound for 6 seconds. The circuitry of control chip 11 then continues to perform the testing of decision block 41.

If the battery voltage is greater than 6.3 volts, then it is tested according to decision block 44 to determine if it is between 6.3 volts and 6.8 volts. An affirmative decision in block 44 means that there is enough energy to turn the present water valve off, but the battery nevertheless needs replacing. As indicated in block 45, an audible signal of 2 hertz is produced by buzzer 16-2 of FIG. 1 for three seconds to indicate this condition.

Control chip 11 then performs the decision of block 46, determining if the X3 DIP initialization switch is set to a "1". An affirmative decision indicates that opening of the water valve is postponed until the soap valve is closed (in the case of a wash fountain, wherein X4="0") or until after a delay is imposed (in the case of a urinal, wherein X4="1"). If X3 is a "1", the control chip logic circuitry turns on the present water valve immediately, as indicated by block 50. If control chip 11 is configured to control a urinal, a selected delay (which can be 16, 32, 48, or 64 seconds, according to the settings of the DIP switches SELZWUR1 and SELZWUR2 with X4="1") is provided, as indicated in block 48, before turning on the present water valve.

In block 51, the logic circuitry again tests the X4 initialization switch to determine if control chip 11 is configured to control a urinal. If that is the case, control chip 11 introduces a delay of 2, 4, 6, or 8 seconds, as indicated in block 52, in accordance with the four possible settings of the DIP switches SELZUR1 and SELZUR2 with DIP switch X4="1", and then turns off the present water valve according to block 63. If control chip 11 is configured to control a wash fountain valve, its logic circuitry resets a timer, as indicated in block 53. The timer can be set to 15, 20, 25, or 30 seconds by the OM1 and OM2 bit switches. After a delay of 5 seconds, as indicated in block 55, the logic circuitry of control chip 11 then sends a 20 millisecond pulse to an external hand dryer, which can be an electric blow dryer, towel dispenser or the like.

The logic circuitry of control chip 11 then determines, according to decision block 57, whether further delay is needed, and if so, five seconds is to be added to the delay of block 55 in accordance with block 58 before turning off the present water valve. If the soap sensor has been activated first, it may be desirable to keep the water flowing for 10 seconds, rather than 5 seconds, to allow the user time to soap his or her hands and before putting his or her hands under the faucet. Control chip 11 then tests the X2 initialization switch bit to determine if the water control cycle is of fixed or variable duration. If it is fixed, the circuitry determines if the maximum time (e.g., 20 seconds) set by DIP switches OM1 and OM2 has expired, and if it has not, the flowchart re-enters decision block 59.

If the variable water flow cycle has been selected, the circuitry, in accordance with decision block 60, compares SENS(Wi) to the maximum and minimum WKLEV (Working Level threshold) values selected by the WK0 and WK1 DIP switches. If the continued presence of hands of a user is not thereby detected for 32 successive times, the logic circuitry of control chip 11 turns off the present water valve Wi, but otherwise determines if the maximum water flow time period has elapsed according to decision block 61. If that is the case, control chip 11 turns off the present water valve Wi, but otherwise re-enters the loop beginning with decision block 59. If a wash fountain is being used, as indicated in block 64, an additional two second delay is introduced before beginning the next water flow control cycle, as indicated in block 65.

Referring next to the flowchart of FIG. 3B, the logic circuitry of chip 11 according to decision block 71 tests the present soap sensor amplifier output level and compares it with the corresponding value of STLEV programmed in by means of DIP switches STZ0 and STZ1. The logic circuitry of control chip 11 then, in accordance with blocks 72, 73, 74, and 75, tests the battery in the manner previously described in FIG. 3A. Then, as indicated in block 76, control chip 11 determines whether DIP switch SELZUR1 has been set to "1" with X4="0", to introduce a 1 second delay according to block 77 between detection of the present soap sensor and turning on of the present corresponding soap valve in label 78. This may be desirable to prevent detection of the user's hand and dispensing of soap before the user's hand has actually moved as far as necessary to receive the dispensed soap.

According to blocks 79, 80, 81, 82, 83, 84, 85, 86, and 87, control chip 11 can select whether the present soap valve $Z_i$ is to be on for 1, 2, 3, or 4 seconds, according to the settings of DIP switches SELZWUR1 and SELZWUR2, with X4="0". When that time has elapsed, the present soap valve $Z_i$ is turned off, as indicated in block 82.

According to blocks 88, 89, and 90, after the present soap valve $Z_i$ has been turned off, either 1 or 2 seconds delay is introduced before the beginning of the next cycle. According to block 91, the logic circuitry of control chip 11 tests initialization switch X3 to determine if opening of the water valve is postponed until the soap valve is closed (in the case of a wash fountain, wherein X4="0") or until after a delay is imposed (in the case of a urinal, wherein X4="1"). If they do, the logic circuitry of control chip 11 repeats the above sequence for the next soap valve $Z_i+1$.

However, if the output of a single sensor, usually one associated with the soap dispenser, turns on both the soap valve and the water valve upon detection of the presence of a user's hands, then the logic circuitry waits until the water valve has been turned off, as indicated in block 92, and then introduces 2 more seconds of delay, as indicated in block 93, before beginning the next "soap cycle".

If the sensor is located at the soap dispenser separate from the faucet, the resulting fixture control cycle must be a fixed length cycle. This is necessary because when the user then moves his hand under the faucet, a variable cycle of the soap sensor would detect non-presence of the user's hand, and then turn the water flow off, which of course would be unacceptable.

The above embodiment of the invention has the capability of either (1) allowing any of a plurality of sensors to effectuate "collective" control of a number of fixtures such as faucet valves, or urinal valves, or (2) allowing "individual" control of each fixture by a single corresponding sensor, i.e., for example, each wash station, urinal, or soap dispenser is controlled according to its individual corresponding sensors. For a "collective" wash fountain, 5 sensors control a single water valve which supplies water to a single "spray ring" with many spray water nozzles or several separate water nozzles. The five sensors are located around the wash fountain. Individual soap dispensers, each with its own associated infrared sensor, may be located adjacent to each of the five water nozzles. In this case, the individual soap valves are controlled as previously described. It should be appreciated that control chip 11 contains the above-described logic circuitry for each water valve and each soap valve, respectively, to be controlled. That is, each valve can be independently controlled by its own dedicated logic circuitry.

Figure 4:
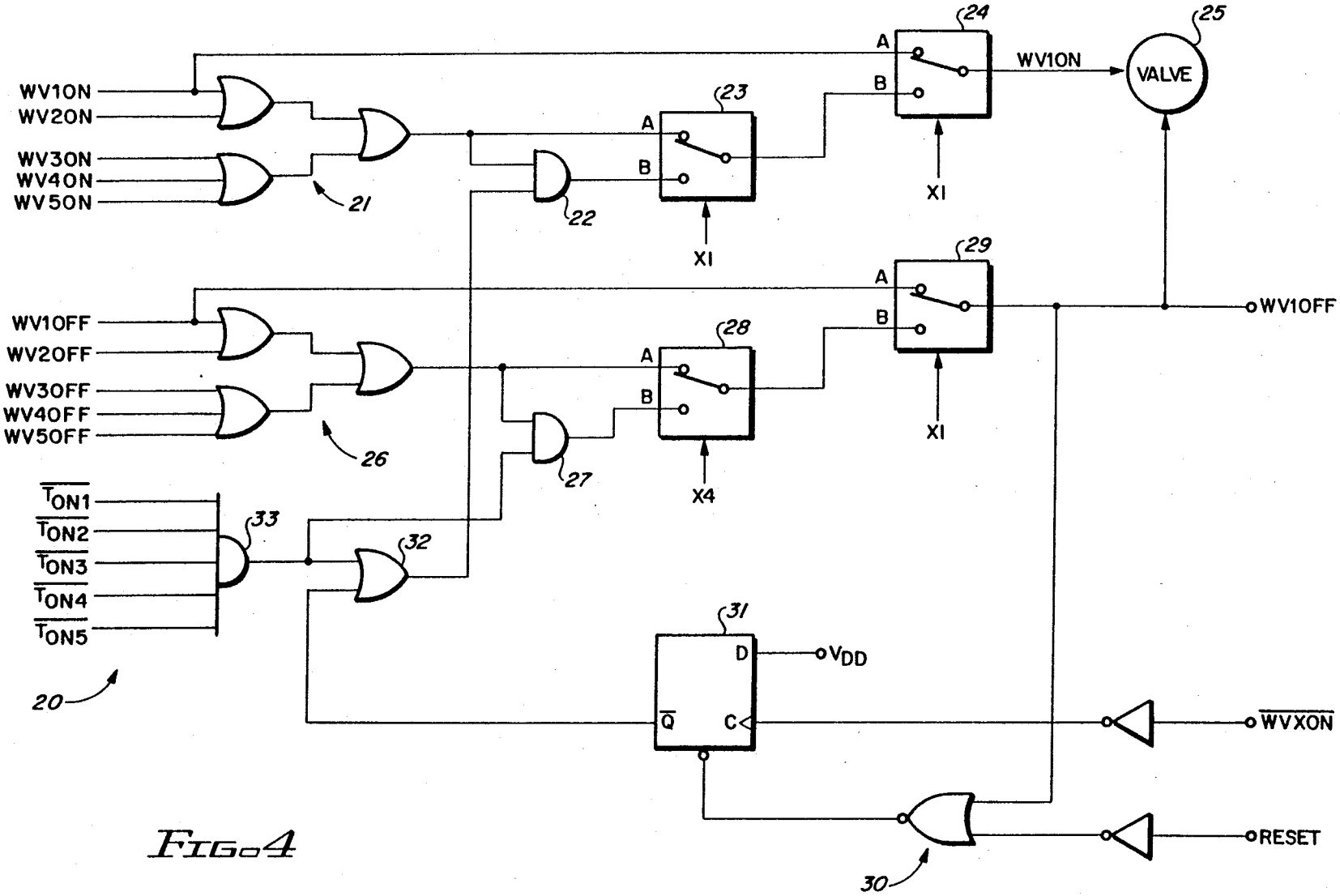
FIG. 4 is a logic diagram of a circuit which controls a valve in response to either a single sensor output signal or a plurality of sensor output signals.

A single control chip 11 is the only one required. In FIG. 4, a WV1ON (Water Valve 1 On) signal (which also is applied to one of the inputs of OR gate circuit 21) produces direct "individual" control of water valve 25 through multiplexor circuit 24 if multiplexer circuit 24 is set by DIP switch Xl being set to "0" so that its A input is connected to the control input of solenoid valve 25.

For "collective" operation, in which one water valve controls water flow from a plurality of spaced nozzles, the B input of multiplexer circuit 24 is selected by X1 being set to "1", and any of the five water valve signals $\overline{WV1ON}$ . . . $\overline{WV5ON}$ is applied to the OR gate structure 21. The circuitry including OR gate circuit 21 and AND gate 22 checks to determine if solenoid valve 25 is already on, and if it is, then no pulse is applied to turn valve 25 on.

The inputs to AND gate 33, which actually functions as an OR gate because "negative logic" is being used, establish the timing of the five different sensors used in the collective configuration. The signals $\overline{T_{ON1}}$, $\overline{T_{ON2}}$ . . . $\overline{T_{ON5}}$ represent the values of the above-described timers for the 5 water valve ports of control chip 11, respectively. Each of these timer signals is reset to a "0" immediately after sensing the presence of a user. A logical "1" applied to the "on" input of solenoid valve 25 opens it. A logical "1" applied to the "off" input of solenoid valve 25 closes it. The circuitry including AND gate 33 and OR gate 32 produces a "1" at the lower input of AND gate 22 if solenoid valve 25 is closed, permitting a "1" output by OR gate circuitry 21 to gate a "1" to the on input of solenoid valve 25, opening it. For "collective" operation, the timer controls how long the water solenoid valve is on, for example 20 seconds. The timer is reset each time any of the sensors in the "collective" configuration indicates the presence of a user. Therefore, as long as a user is present at any of the 5 sensors, water valve 25 remains on and cannot be turned off by any of the WV1OFF, WV2OFF, . . . WV5OFF signals. As long as any one of the five $\overline{T_{ON1}}$, $\overline{T_{ON2}}$ . . . $\overline{T_{ON5}}$ values is a "0", no additional turn on pulses can be applied to valve 25 until after it is turned off in one of the ways described earlier. For example, if control chip 11 produces a WVON3 signal equal to a "1" the corresponding timer signal $\overline{T_{ON5}}$ is immediately set to a "0". Therefore, the left input of OR gate 32 is a "0". The right input of OR gate 32 is a "1" indicating that valve 25 is closed. The lower input of AND gate 22 is a "1", allowing valve 22 to be opened only if it is presently closed. When valve 25 is opened, flip-flop 31 produces a "0" at the right input of OR gate 32. After that time, valve 25 cannot be opened again because a "0" is produced at the lower input of AND gate 22. Only when valve 25 is closed can flip-flop 31 produce a "1" at the input of AND gate 22 enabling any of the input to OR circuitry 21 to open valve 25. When valve 25 is successfully turned off by a signal at the output of multiplexor 29, the necessary state is stored in flip-flop 31 to produce a "1" on the right input of OR gate 32 and the lower input of AND gate 22 indicating that valve 25 is closed.

The resulting elimination of unnecessary water valve turn on pulses advantageously reduces overall power consumption. In the "collective" configuration, AND gate 27 prevents any of the WV1OFF, WV2OFF . . . WV5OFF signals from closing valve 25 if the presence of a user is detected at any of the other sensors because its timer signal produces a "0" at an input of AND gate 33, producing a "0" at one input of AND gate 27, disabling the output of OR circuit 26 from reaching the B input of multiplexor 29.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, control chip 11 can be adapted to control lights, security systems, air exhaust systems, toilet seat cover dispensing, ventilation, and other functions. As another example, control chip 11 can be implemented by a conventional microprocessor or microcomputer programmed to perform the functions of the flowchart of FIGS. 3A and 3B, rather than by a logic circuit configured to perform the functions defined by the state table of Table 1. The system can, of course, be powered by an inexpensive power supply instead of a battery pack if AC line voltage is readily available.

What is claimed is:

1. A method of operating a control system including water valves and soap valves to automatically control the water valves and soap valves, the method comprising the steps of:

(a) operating a first infrared sensor to sense the presence of a user close enough to a first water valve to indicate the user's intention to use the first water valve, by comparing an output signal of the first infrared sensor to a first threshold and indicating user presence if the magnitude of the output signal exceeds the first threshold and repeating step (a) if user presence is not indicated;

(b) if user presence is indicated, testing a battery that supplies power to the first water valve to determine if the battery contains enough energy to close the first water valve, and, if not, both i. producing a first alarm indication, and ii. preventing further opening of the first water valve;

(c) testing a first configuration switch to determine if opening of the water valve is to be postponed;

(d) immediately opening the first water valve if opening of the first water valve is not to be postponed, and otherwise waiting until the first soap valve is closed and then opening the first water valve;

(e) resetting a water valve timer and operating the water valve timer to measure the duration of water flow through the first water valve if the first water valve is for a wash fountain;

(f) generating a hand dryer device control signal after a first delay;

(g) testing a second configuration switch to determine if the duration is to be variable;

(h) if the duration is to be variable, operating the first infrared sensor to sense continued presence of the user near the first water valve by comparing the output signal of the first infrared sensor to a second threshold that is lower in magnitude than the first threshold;

(i) closing the first water valve if the output signal of the first infrared sensor is less than the second threshold or the water valve timer has exceeded a maximum setting; and (j) closing the first water valve if the water valve timer has exceeded the maximum setting.

2. The method of claim 1 including testing the battery to determine if it needs replacing in the near future and, if so, producing a second alarm indication before performing step (c).

3. The method of claim 2 including testing a third configuration switch to determine if the first water valve is for a wash fountain or a urinal, and if it is for a wash fountain, directly performing step (d), and if it is for a urinal, performing step (d) after a second delay.

4. The method of claim 3 including, if the first water valve is for a urinal, waiting for a third delay and then closing the first water valve.

5. The method of claim 4 including (k) operating a second infrared sensor to sense the presence of a user close enough to the first soap valve to indicate the user's intention to use the first soap valve, by comparing an output signal of the second infrared sensor to a third threshold and indicating user presence if the magnitude of the output signal exceeds the third threshold;

(l) testing a battery that supplies power to the first soap valve to determine if the battery contains enough energy to close the first soap valve, and both i. producing the first alarm indication, ii. preventing further opening of the first soap valve if the determination is negative;

(m) opening the first soap valve for a first duration and then closing the first soap valve.

6. The method of claim 1 wherein the control system includes a second infrared sensor, the method including testing a third configuration switch to determine if the first water valve controls water through a plurality of nozzles, and wherein step (a) includes operating the second infrared sensor in the same manner as the first, and wherein step (d) includes opening the first water valve in response to either the output signal of the first infrared sensor or an output signal of the second infrared sensor if the testing of the third configuration switch determines that the first water valve controls water flow through the plurality of nozzles.

7. The method of claim 5 wherein the control system includes a second infrared sensor, the method including testing a fourth configuration switch to determine if the first water valve controls water through a plurality of nozzles, and wherein step (a) includes operating the second infrared sensor in the same manner as the first, and wherein step (d) includes opening the first water valve in response to either the output signal of the first infrared sensor or an output signal of the second infrared sensor if the testing of the fourth configuration switch determines that the first water valve controls water flow through the plurality of nozzles.

8. The method of claim 1 including, before step (g), testing a third configuration switch to determine if increased duration of water flow through the first water valve is desired, and if so, delaying step (g) by a preselected delay.

9. The method of claim 6 wherein the second configuration switch is set to cause the duration of water flow through the first water valve to be fixed, the method including resetting or retriggering the water valve timer in response to an output signal of either the first infrared sensor or the second infrared sensor.

10. A method of operating a control system including water valves and soap valves to automatically control the water valves and soap valves, the method comprising the steps of:

(a) operating a first infrared sensor to sense the presence of a user close enough to a first soap valve to indicate the user's intention to use the first soap valve, by comparing an output signal of the first infrared sensor to a first threshold and indicating user presence if the magnitude of the output signal exceeds the first threshold and repeating step (a) if user presence is not indicated;

(b) if user presence is indicated, testing a battery that supplies power to the first soap valve to determine if the battery contains enough energy to close the first soap valve, and, if not, both i. producing a first alarm indication, and ii. preventing further opening of the first water valve;

(c) testing a first configuration switch to determine if a first delay is desired before opening the first soap valve, and if so, waiting for the first delay before performing step (d);

(d) opening the first soap valve for a preselected first duration and then closing the first soap valve;

(e) delaying a preselected amount of time before performing step (f);

(f) testing a second configuration switch to determine if a first soap valve and the first water valve are to be independently controlled;

(g) if the first soap valve and the first water valve are to be independently controlled, delaying the performing of step (h) until the first water valve is closed and further delaying performing step (h) an additional predetermined amount of time;

(h) operating a first infrared sensor to sense the presence of a user close enough to a first water valve to indicate the user's intention to use the first water valve, by comparing an output signal of the first infrared sensor to a first threshold and indicating user presence if the magnitude of the output signal exceeds the first threshold and repeating step (h) if user presence is not indicated;

(i) testing a battery that supplies power to the first water valve to determine if the battery contains enough energy to close the first water valve, and, if not, both i. producing a first alarm indication, and ii preventing further opening of the first water valve;

(j) testing the second configuration switch to determine if opening of the water valve is to be postponed;

(k) immediately opening the first water valve if opening of the first water valve is not to be postponed, and otherwise waiting until the first soap valve is closed and then opening the first water valve;

(l) resetting a water valve timer and operating the water valve timer to measure the duration of water flow through the first water valve if the first water valve is for a wash fountain;

(m) generating a hand dryer device control signal after a first delay;

(n) testing a third configuration switch to determine if the duration is to be variable;

(o) if the duration is to be variable, operating the first infrared sensor to sense continued presence of the user near the first water valve by comparing the output signal of the first infrared sensor to a second threshold that is lower in magnitude than the first threshold;

(p) closing the first water valve if the output signal of the first infrared sensor is less than the second threshold or the water valve timer has exceeded a maximum setting; and (q) closing the first water valve if the water valve timer has exceeded the maximum setting.

11. A control system for automatically controlling water valves and soap valves, comprising in combination:

(a) a first water valve, a first soap valve, battery means for supplying power to the first water valve and the first soap valve, and a first infrared sensor;

(b) means for operating the first infrared sensor to sense the presence of a user close enough to the first water valve to indicate the user's intention to use the first water valve, by comparing an output signal of the first infrared sensor to a first threshold and indicating user presence if the magnitude of the output signal exceeds the first threshold;

(c) means for producing the first threshold in response to a first configuration switch;

(d) means for testing the battery means to determine if the battery means contains enough energy to close the first water valve;

(e) alarm means responsive to the battery testing means for (1) producing a first alarm indication, and (2) preventing further opening of the first water valve if the determination is negative;

(f) a second configuration switch and means for testing the second configuration switch to determine if opening of the water valve is to be postponed;

(g) means responsive to the first configuration switch testing means for immediately opening the first water valve if opening of the first water valve is not to be postponed, and otherwise waiting until the first soap valve is closed and then opening the first water valve;

(h) a water valve timer, means for resetting the water valve timer, and means for operating the water valve timer to measure the duration of water flow through the first water valve if the first water valve is for a wash fountain;

(i) means for generating a hand dryer device control signal after a first delay;

(j) a third configuration switch and means for testing the third configuration switch to determine if the duration is to be variable;

(k) means for operating the first infrared sensor to sense continued presence of the user near the first water valve by comparing the output signal of the first infrared sensor to a second threshold that is lower in magnitude than the first threshold if the duration is to be variable; and (l) means for closing the first water valve if the output signal of the first infrared sensor is less than the second threshold or the water valve timer has exceeded a maximum setting.

12. The control system of claim 11 including testing the battery means to determine if it needs replacing in the near future and means for producing a second alarm indication if the battery means needs replacing in the near future.

13. The control system of claim 12 including a fourth configuration switch to determine if the first water valve is for a wash fountain or a urinal, and means for opening the first water valve after a second delay if the water valve is for a urinal.

14. The control system of claim 11 including a second infrared sensor and means for operating the second infrared sensor to sense the presence of a user close enough to the first soap valve to indicate the user's intention to use the first soap valve, by comparing an output signal of the second infrared sensor to a third threshold and indicating user presence if the magnitude of the output signal exceeds the third threshold, means for testing the battery means to determine if the battery means contains enough energy to close the first soap valve, and means for both (1) producing the first alarm indication, and (2) preventing further opening of the first soap valve if the determination is negative, and means for opening the first soap valve for a first duration and then closing the first soap valve.

15. A method of operating a control system including water valves and soap valves to automatically control the water valves and soap valves, the method comprising the steps of:

(a) operating a first infrared sensor to sense the presence of a user close enough to a first water valve to indicate the user's intention to use the first water valve, by comparing an output signal of the first infrared sensor to a first threshold and indicating user presence if the magnitude of the output signal exceeds the first threshold and repeating step (a) if user presence is not indicated;

(b) testing a first configuration switch to determine if opening of the first water valve is to be postponed;

(c) immediately opening the first water valve if opening of the first water valve is not to be postponed, and otherwise waiting until the first soap valve is closed and then opening the first water valve;

(d) resetting a water valve timer and operating the water valve timer to measure the duration of water flow through the first water valve if the first water valve is for a wash fountain;

(e) testing a second configuration switch to determine if the duration is to be variable;

(f) if the duration is to be variable, operating the first infrared sensor to sense continued presence of the user near the first water valve by comparing the output signal of the first infrared sensor to a second threshold and closing the first water valve if continued presence of the user is not detected;

(g) closing the first water valve if the water valve timer has exceeded the maximum setting.

16. The method of claim 15 wherein the second threshold is lower in magnitude than the first threshold.

17. A method of operating a control system to automatically control fixtures of a washroom, the method comprising the steps of:

(a) operating a first infrared sensor to sense the presence of a user close enough to a first fixture to indicate the user's intention to use the first fixture, by comparing an output signal of the first infrared sensor to a first threshold and indicating user presence if the magnitude of the output signal exceeds the first threshold and repeating step (a) if user presence is not indicated;

(b) testing a first configuration switch to determine if actuating of the first fixture is to be postponed;

(c) immediately actuating the first fixture if actuating of the first fixture is not to be postponed, and otherwise waiting until a second fixture is actuated and then actuating the first fixture;

(d) resetting a fixture timer and operating the fixture timer to measure the duration of actuation of the first fixture;

(e) testing a second configuration switch to determine if the duration is to be variable;

(f) if the duration is to be variable, operating the first infrared sensor to sense continued presence of the user near the first fixture by comparing the output signal of the first infrared sensor to a second threshold and deactuating the first fixture if continued presence of the user is not detected;

(g) deactuating the first fixture if the fixture timer has exceeded the maximum setting.

* * * * *